US006948190B2

(12) United States Patent
McGreggor

(10) Patent No.: US 6,948,190 B2
(45) Date of Patent: Sep. 27, 2005

(54) HEAD AND HAIR COVER

(76) Inventor: Carlin Denise McGreggor, 23645 Meadow Ridge Dr., K-167, Newhall, CA (US) 91321

( * ) Notice: Subject to any disclaimer, the term of this patent is extended or adjusted under 35 U.S.C. 154(b) by 0 days.

(21) Appl. No.: 10/974,616

(22) Filed: Oct. 27, 2004

(65) Prior Publication Data

US 2005/0132471 A1 Jun. 23, 2005

Related U.S. Application Data

(63) Continuation of application No. 10/133,542, filed on Apr. 26, 2002, now abandoned.

(51) Int. Cl.[7] ..... A42B 1/04
(52) U.S. Cl. ..... 2/202

(58) Field of Search ..... 2/174, 202, 206, 2/207, 204; 132/274

(56) References Cited

U.S. PATENT DOCUMENTS 2,581,366 A * 1/1952 De Grazia ..... 2/203

* cited by examiner

*Primary Examiner*—Katherine Moran
(74) *Attorney, Agent, or Firm*—Colin P. Abrahams

(57) ABSTRACT

A head-hair cover comprises a body defining a chamber and an opening in the body. The opening has a peripheral edge and permits communication between the chamber and outside of the cover. An adjustment mechanism is provided at or near the peripheral edge for selectively varying the dimensions of the opening. Additionally, a constricting band is provided and associated with the peripheral edge for gently crimping at least a portion of the peripheral edge.

8 Claims, 4 Drawing Sheets

HEAD AND HAIR COVER

CROSS REFERENCE TO RELATED APPLICATIONS

This application is a continuation application U.S. patent application Ser. No. 10/133,542 filed Apr. 26, 2002, now abandoned which is incorporated herein by reference in its entirety.

FIELD AND BACKGROUND OF INVENTION

This invention relates to a head and hair cover, a hair scarf and related items. The invention has particular advantage when used by people having long hair, and is designed to cover the head, and contain the person's hair, during sleep, as protection or for sanitary purposes during working, or in such other applications as may be beneficial.

The use of hair covers, hair scarves and hair ties are well known in the prior art. Hair scarves and ties can range widely in variety from the most simple forms, such as clips, elastic bands, barrettes, or the like, for keeping the hair in the desired place, to more elaborate forms of head covers intended to cover part of the head and/or keep the head covered. Such hair covers may be used by workers operating dangerous machinery in which the hair could be become ensnared and thus pose a danger to the individual, or by others, such as those in the service industry, such as at restaurants where personnel handling food may be required, for health and sanitary reasons, to keep their hair covered.

An example of a hair scarf or tie shown in the prior art is illustrated in U.S. Pat. No. 5,878,756 (Bilodeau). In this patent, there is disclosed an athletic hair tie having a distinct cap portion, which is attached to a hair sleeve 20. The cap portion fits over the head, while the sleeve portion, including a plurality of tabs, keeps the hair in place. Means for securing the cap portion snugly on the head of the user are provided.

Other types of head gear for containing the hair are also known, such as simple donned caps with elasticized edges, which can be fitted over the head and will remain there due to the elasticity properties about the periphery.

SUMMARY OF THE INVENTION

In one aspect, the present invention is for a head and hair cover which may be easy to put on and remove, is adjustable in various manners for maximum comfort, and is intended to cover the hair without deforming it or squashing it in an undesirable manner.

Preferably, the head and hair cover of the invention is a continuously configured tube-like structure, having a head portion which is easily adjustable and variable to provide a comfortable fit, and a hair portion continuous therewith which accommodates the hair, preferably in a manner which would interfere as little as possible with the hair style or shape.

The head and hair cover of the invention is preferably comprised of a soft, light-weight fabric, and may preferably be slightly expandable so that it will not compress the hair or head of the user.

According to one aspect of the invention, there is provided a head-hair cover comprising: a body defining a chamber; an opening in the body, the opening having a peripheral edge and permitting communication between the chamber and outside of the cover; adjustment means at or near the peripheral edge for selectively varying the dimensions of the opening; and constricting means associated with the peripheral edge for gently crimping at least a portion of the peripheral edge.

Preferably, the body is formed of two lateral panels stitched together along their respective peripheral edges, the opening being defined by corresponding portions of the peripheral edges of the two lateral panels which remain unattached. The body may comprise a head portion, in which the opening is located, and a hair containing portion therebelow.

In a preferred embodiment, the cover has a body which is comprised of a soft, elasticized fabric.

Preferably, the adjustment means comprises a channel formed by a hem along at least a portion of the peripheral edge of the opening, and a cord extending from inside the channel to the outside thereof, the arrangement of the cord relative to the channel being adjustable to vary the dimensions of the opening.

The constricting means may comprise a length of elastic band along at least a portion of the peripheral edge for crimping the peripheral edge over the portion thereof at which it is located.

In another embodiment, the body is formed as a single piece to define the chamber and has a cut therein in the upper portion of the body to define the opening.

DETAILED DESCRIPTION OF THE INVENTION

With reference to the drawings, there is shown various perspectives of a head and hair cover in accordance with the present invention. The head and hair cover contains a number of features which facilitate putting on the cover, and adjusting it in a manner which is comfortable, and assumes the shape of the user's head and hair. The head and hair cover of the invention is intended to keep the hair contained therewithin, but without disturbing the style of the hair.

The head and hair cover of the invention may be used in a number of contexts. It may be used when sleeping to keep the hair from spreading or losing its shape, or it may be used as a sanitary cover (such as when the user is preparing food), or a protector when the user is operating machinery in which the hair may become entangled, thus posing a danger to the user.

Figure 1:
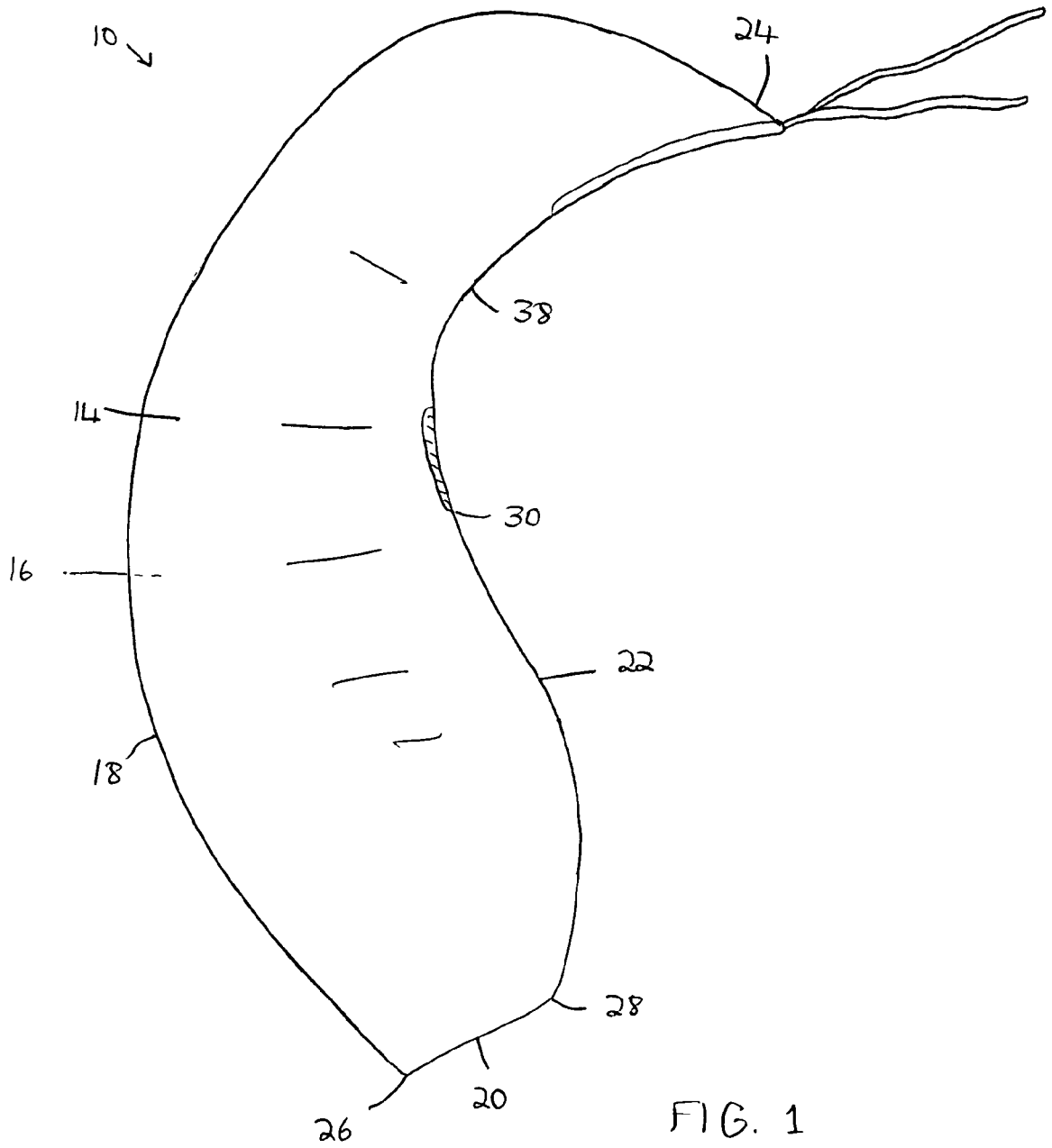
FIG. 1 is a side view of the head and hair cover of the invention.
Figure 2:
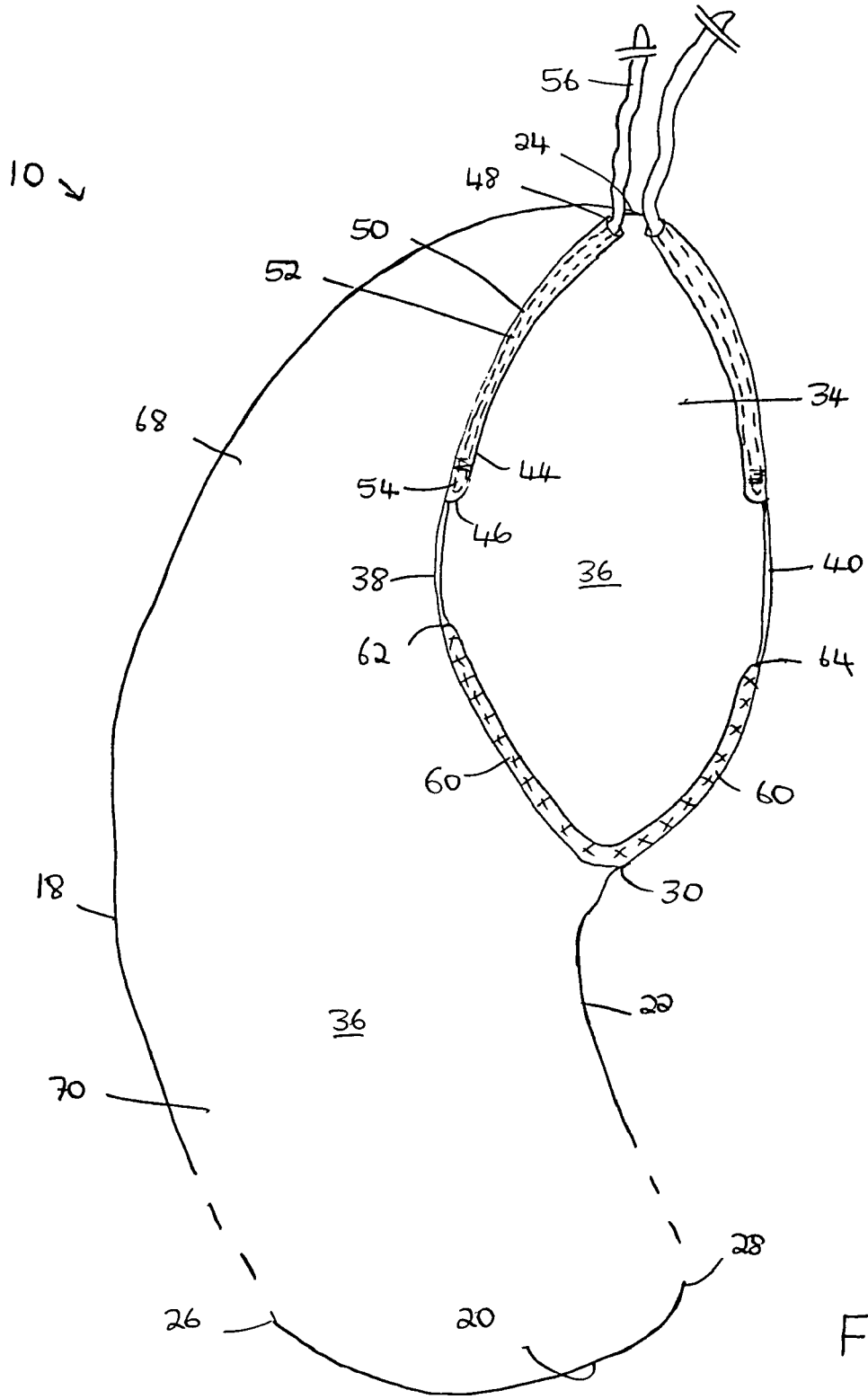
FIG. 2 is a perspective view of the head and hair cover of the invention as shown in FIG. 1, in an open position and illustrating the various components thereof.

FIG. 1 of the drawings shows a side view of the head and hair cover 10 in accordance with the invention. The cover 10 is essentially comprised of two identical panels, which are mirror images of each other. Thus, there is provided a first lateral panel 14 and a second lateral panel 16 (clearly illustrated in FIG. 3 of the drawings), the two panels 14 and 16 being of substantially identical shape, and overlying each other.

Each panel 14 and 16 comprises a back edge 18, a base edge 20, and a front edge 22. Each of the first and second lateral panels 14 and 16 is comprised of preferably a soft and light-weight fabric, such as nylon, polyester, cotton and the like, although any suitable material may be used. Further, a preferred embodiment of the invention would be one where each of the first and second lateral panels 14 and 16 is comprised, at least in part, of a material which has some elastic properties, so that it is capable of, at least to a small extent, expanding and contracting back to its normal size depending upon use requirements.

Each of the first and second lateral panels 14 and 16 is connected to each other preferably by stitching along the back edge 18 thereof, from approximately point 24 to the point 26. Further, the base edges 20 of each of the first and second lateral panels 14 and 16 are also connected to each other, preferably by stitching, between the points 26 and 28. With respect to the front edge 22, the first and second lateral panels 14 and 16 are partially attached to each other, once more preferably by stitching. The front edges 22 of the first and second lateral panels 14 and 16 are attached to each other between the point 28, near the base edge 20, and the point 30, about midway up the length of the front edge 22. Therefore, it will be appreciated that the first and second lateral panels 14 and 16 are sewn together along substantially their entire periphery, from point 24 to 26, point 26 to 28, and point 28 to 30. However, the front edge 22 of the first and second lateral panels 14 and 16 respectively remains unattached between points 24 and 30, creating an opening 34. The opening 34 provide access to a chamber 36, which is of a generally tube-like shape.

The opening 34 is defined by first peripheral edge 38, which forms part of the front edge 22 of the first lateral panel, and the second peripheral edge 40, which forms part of the front edge 22 of the second lateral panel 16.

Each of the first and second peripheral edges 38 and 40 comprises a hem 44, each hem 44 having a sealed or closed end 46 and an open end 48. The hem 44 defines a channel 50 between the sealed end 46 and open end 48 respectively. A cord 52, which generally comprises a fabric strip, is located within the channel 50, and has one inside end 54 fastened near the sealed end 46. The inside end 54 is preferably fastened near the sealed end by appropriate stitching. The cord 52 extends through the channel 50, through the open end 48, so that outside portion 56 of the cord 52 hangs loosely. The outside portion 56 of each cord 52 along the first and second peripheral edges 38 and 40 respectively can be used, as will be described in further detail below, to tighten or loosen the cover 10, thereby varying the size of the opening 34 so as to be customized and comfortable for the user.

The first peripheral edge 38 and second peripheral edge 40 each have an elastic band 60 extending therealong from points 62 and 64 respectively down to the point 30. The elastic bands 60 are sewn along the peripheral edges 38 and 40, or may be contained within a hem formed along this portion of the edge. It is not important to the invention exactly how the elastic band 60 is fastened along the edge, only that it is present. The purpose of the elastic band 60 is to provide a light pressure, tending to gather or fold slightly the peripheral edges 38 and 40 along the length at which they, the elastic bands 60, are located, providing a small, but comfortable and effective, pressure tending to close the opening 34. As will be described below, the elastic band 60, together with the cords 52, provide an advantageous mechanism for adjusting the size of the opening 34 to the precise requirements of the wearer.

In use, the cover 10 of the invention is designed and configured to carefully hold the hair, and to fit about the head in a comfortable and proper location. This is achieved by the overall configuration of the cover 10, as well as the features defining the opening 34, and the mechanisms for adjusting the size of the opening 34 to desired dimensions.

In use, the wearer's hair is carefully lifted and inserted through the opening 34 so that it will be contained within the chamber 36. The size of the chamber 36 can, of course, be determined according to the size and shape of the first and second lateral panels 14 and 16. These panels 14 and 16 can therefore be cut and dimensioned in different ways, to suit the needs of different users. The hair passed through the opening 34 and into the chamber 36 will remain there, and, depending upon the length of the hair, may extend all the way to the base edge 20, or it may simply hang without the ends touching the base edge 20.

The cover 10 is therefore essentially divided into a head portion 68 and a hair container portion 70. The hair, when passing through the opening 34, enters the head portion 68 of the chamber 36, and then, according to the length of the hair, will fall, to some extent or another, within the hair container portion 70.

Figure 3:
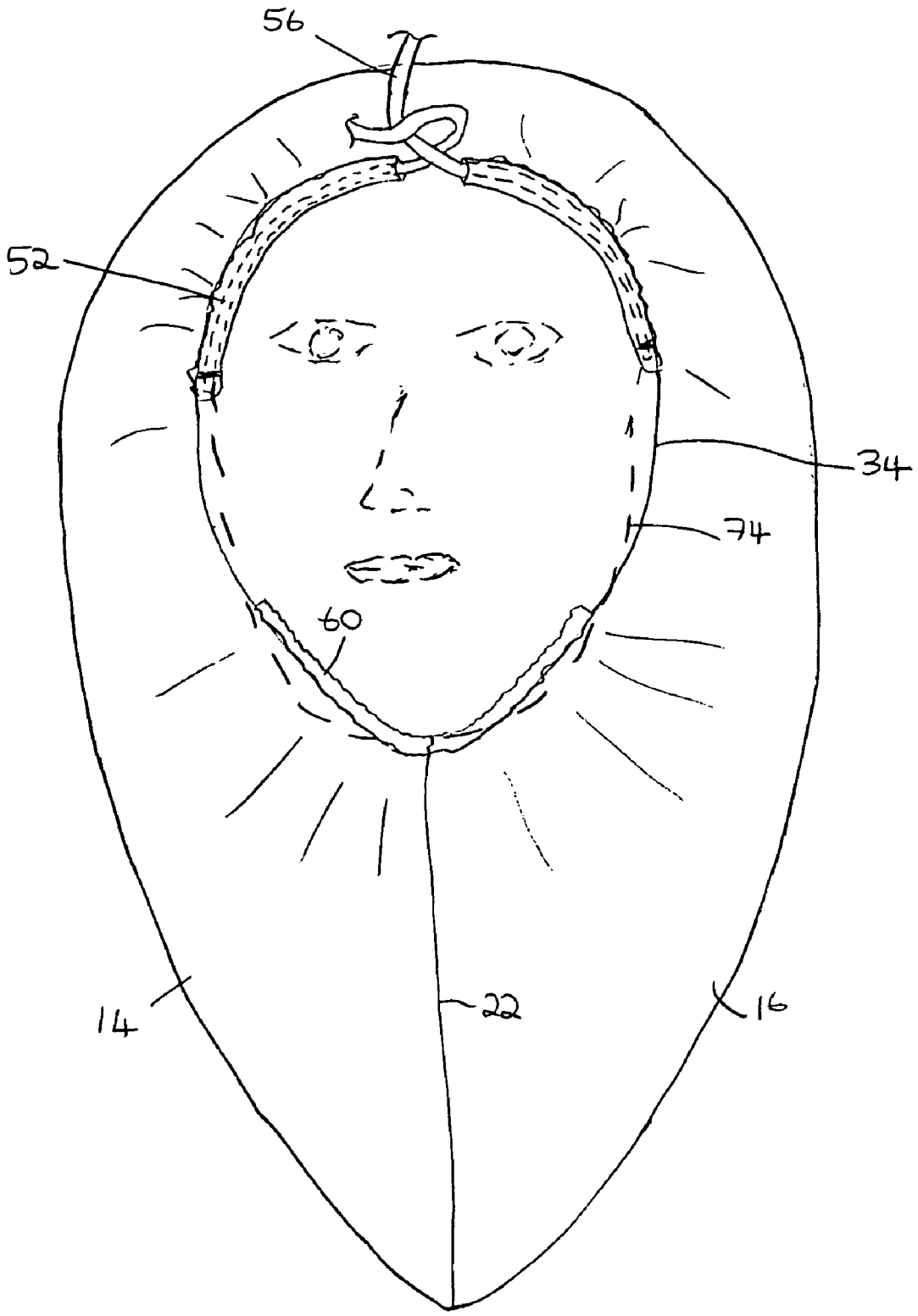
FIG. 3 is a front view of the head and hair cover of the invention shown in FIG. 1 of the drawings.
Figure 4:
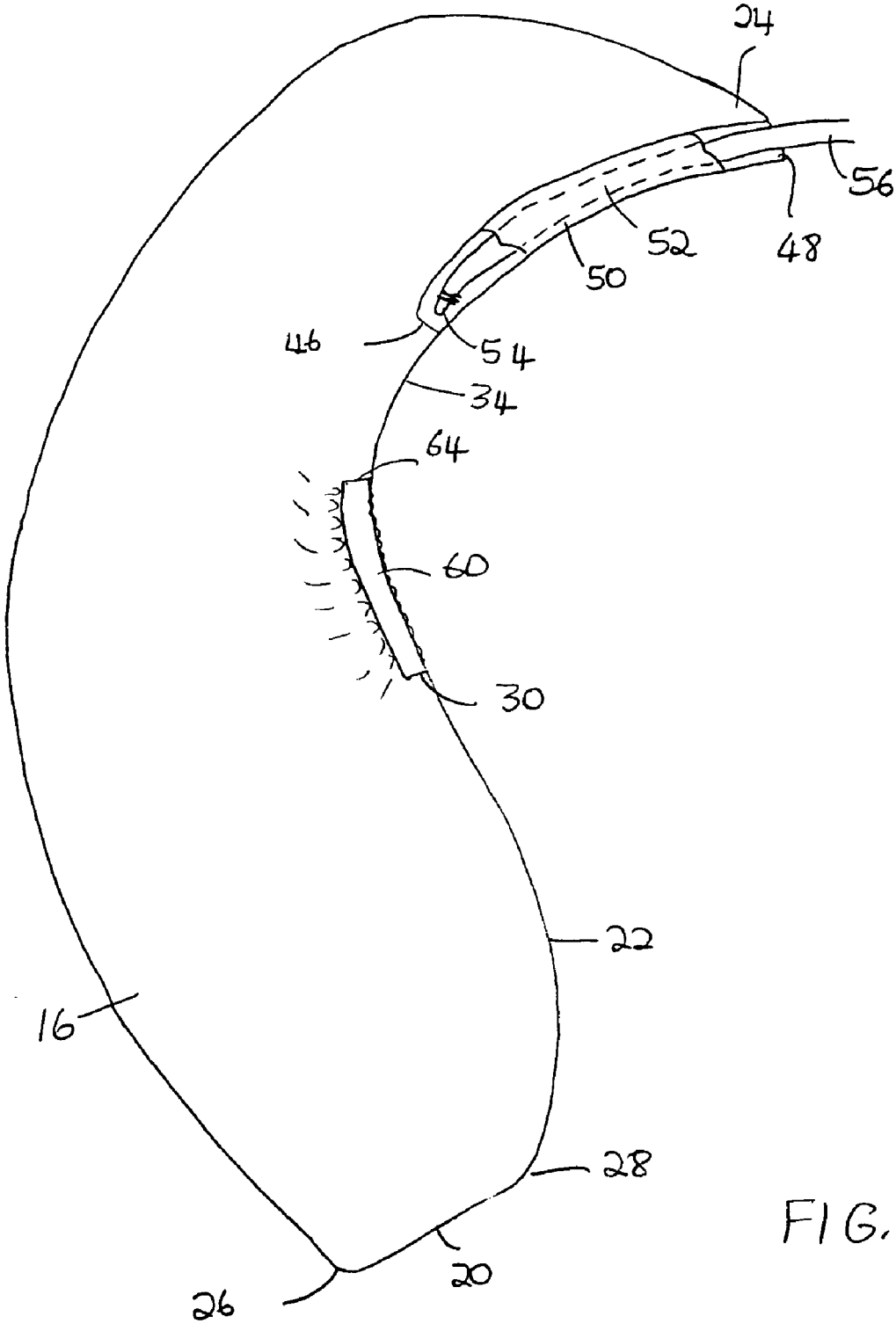
FIG. 4 is a side view of one of the panels of the head and hair cover of the invention as shown in FIG. 1 of the drawings.

The cover 10 is then pulled over the head such that the point 24 is approximately on the forehead of the wearer, while the point 30 rests more or less on the back of the neck of the wearer. The first and second peripheral edges 38 and 40 extend from the forehead, across the cheeks, either in front or behind the ears, and towards the back of the neck. FIG. 3 of the drawings shows in phantom outline the face 74 of the user relative to the cover 10.

The cover 10 remains comfortable on the head, and the tightness thereof, and particularly the opening 34, can be adjusted. First, the elastic band 60 tends to crimp or fold the peripheral edges 38 and 40 so as to draw the opening 34 tightly around the head and face. However, the cover 10 is still loose enough, and can be elastically extended, so as to make the opening 34 bigger or smaller for putting on or removing. In addition, the user is able to pull the cord 52 along the first and second peripheral edges 38 and 40, thus gathering the hem 34 and thereby constricting the opening 34 until a comfortable sized opening 34 has been achieved. At that point, the outside portions 56 of the cord 52 are knotted or bowed to keep the cords held and tensioned in the desired position.

Thus, between the operation of the elastic bands 60, and the cords 52, appropriately joined and connected to each other, the size of the opening 34 can be carefully and comfortably adjusted by the user.

While the cover 34 worn, the hair is contained within the soft and somewhat elasticized lateral panels 14 and 16, and the hair is able, to a large extent, to hang substantially naturally within the hair container portion 70. One potential advantage of the cover 10 is therefore that the hair will not be flattened or pressed into undesired positions by the action of the cover 10, which, in one embodiment, essentially surrounds and contains the hair without significantly altering its position.

Variations of the invention are possible. For example, instead of having first and second lateral panels 14 and 16, a single piece may be used, and stitched together, or molded as a tube, to the desired shape. Further, the elastic bands 60 may not necessarily be only, or even, at the lower portion of the opening 34, but can be effectively located at one or more points along the periphery of the opening. Further still, the cords 52 may be near the bottom of the opening, or at the side thereof, rather than at the top. The cords may also be kept together and fastened by means of a clip or other device instead of the requirement that they be knotted or tied by their loose ends only.

Further, the position of the cords 52 and elastic band 60 may be reversed, so that the elastic is at the top, and the cords at the bottom.

What is claimed is:

1. A head-hair cover comprising:

a body defining a chamber, the body having a head portion and a hair containing portion below the head portion;

an opening in the head portion only of the body, the opening having a peripheral edge and permitting communication between the chamber and outside of the cover, the peripheral edge having at least a first adjustment section and a second adjustment section separate from the first adjustment section;

at least one cord member at or near the first adjustment section of the peripheral edge for selectively varying the dimensions of the first adjustment section of the peripheral edge; and constricting means associated with the second adjustment section of the peripheral edge for gently crimping at least a portion of the second adjustment section of the peripheral edge.

2. A cover as claimed in claim 1 wherein the body is formed of two lateral panels stitched together along their respective peripheral edges, the opening being defined by corresponding portions of the peripheral edges of the two lateral panels which remain unattached.

3. A cover as claimed in claim 1 wherein the body is comprised of a soft, elasticized fabric.

4. A cover as claimed in claim 1 wherein the first adjustment section comprises a channel formed by a hem along the peripheral edge of the opening, and the cord extends from inside the channel to the outside thereof, the arrangement of the cord relative to the channel being adjustable to vary the dimensions of the opening.

5. A cover as claimed in claim 1 wherein the constricting means comprises a length of elastic band along the second adjustment section of the peripheral edge for crimping the peripheral edge over the portion thereof at which it is located.

6. A cover as claimed in claim 1 wherein the body is formed as a single piece to define the chamber and has a cut therein in the upper portion of the body to define the opening.

7. A cover as claimed in claim 1 wherein the first and second adjustment sections of the peripheral edge are separated and apart from each other along the peripheral edge so as to define additional sections between the first and second adjustment sections.

8. A cover as claimed in claim 1 further comprising additional sections between the first and second adjustment sections.

* * * * *